US009808391B1

(12) United States Patent
Carrig

(10) Patent No.: US 9,808,391 B1
(45) Date of Patent: Nov. 7, 2017

(54) WALKER SAFETY DEVICE

(71) Applicant: Lorie Zacharias-Verdi, Kansas City, MO (US)

(72) Inventor: Eamon Carrig, Somerville, MA (US)

(73) Assignee: Lorie Zacharias-Verdi, Kansas City, MO (US)

( * ) Notice: Subject to any disclaimer, the term of this patent is extended or adjusted under 35 U.S.C. 154(b) by 0 days.

(21) Appl. No.: 15/204,032

(22) Filed: Jul. 7, 2016

Related U.S. Application Data

(60) Provisional application No. 62/193,172, filed on Jul. 16, 2015.

(51) Int. Cl.
*G08B 23/00* (2006.01)
*A61H 3/00* (2006.01)
*G08B 21/02* (2006.01)

(52) U.S. Cl.
CPC ..... *A61H 3/00* (2013.01); *G08B 21/0225* (2013.01); *G08B 21/0233* (2013.01); *A61H 2201/0184* (2013.01); *A61H 2201/5043* (2013.01); *A61H 2201/5048* (2013.01); *A61H 2201/5064* (2013.01)

(58) Field of Classification Search
CPC ..... A61H 3/00; A61H 2201/50; A61H 2201/501; A61H 2201/0107; A61H 2201/0173; A61H 2201/0184; A61H 2201/5043; A61H 2201/5048; A61H 2201/5061; A61H 2201/5064; A61H 2201/5079; A61H 2201/5084; A61H 3/04; A61H 3/061; G08B 21/0225; G08B 21/0233; G08B 21/0461; A61B 5/103; A61B 5/112; A61B 5/225; A61B 5/0022; A61B 5/1036; A61B 5/1038; A61B 5/1123; A61B 5/1113; A61B 5/1116; A61B 5/1117; A61B 5/1118; A61B 5/4023; A61B 5/6807; A61B 5/6829
See application file for complete search history.

(56) References Cited

U.S. PATENT DOCUMENTS

| | | | |
|---|---|---|---|
| 5,311,880 | A | 5/1994 | Lancaster et al. |
| 5,511,571 | A | 4/1996 | Adrezin et al. |
| 5,794,639 | A | 8/1998 | Einbinder |
| 5,853,219 | A | 12/1998 | Santuccio |
| 5,865,450 | A | 2/1999 | Ulrich |
| 6,011,481 | A | 1/2000 | Luther et al. |

(Continued)

OTHER PUBLICATIONS

Article: Rachel O'Connell, "Alert System and Cadence Walker," Spring 2013, University of Wisconsin.

(Continued)

*Primary Examiner* — John A. Tweel, Jr.
*Assistant Examiner* — Adnan Aziz
(74) *Attorney, Agent, or Firm* — Erickson Kernell IP, LLC

(57) ABSTRACT

A safety device for a walker includes a distance measuring sensor for determining whether a user is at too far or too close distances relative to the front side of the walker. The sensor provides data to a CPU processor indicative of such events. The processor includes logic which analyzes such data and provides audial, visual and/or tactile stimuli to the user warning the user that he/she is at undesirable distances relative to the walker. The process logic can be modified so as to vary the type and/or frequency of warnings given to the user.

18 Claims, 8 Drawing Sheets

(56) References Cited

U.S. PATENT DOCUMENTS 6,930,603 B2 * 8/2005 Jackson ..... G08B 21/22 135/65
7,385,514 B2 6/2008 Dempsey
7,826,983 B2 * 11/2010 Alwan ..... A61B 5/1038 702/33
7,963,294 B1 * 6/2011 Trout ..... A61H 3/00 135/66
8,453,662 B2 * 6/2013 Trout ..... A61H 3/00 135/66
8,460,219 B2 6/2013 Miyake
8,702,567 B2 * 4/2014 Hu ..... A61H 3/00 482/8
8,810,407 B1 * 8/2014 Nolan ..... A61H 3/02 340/407.1
8,974,232 B2 * 3/2015 Behrenbruch ..... A45B 3/00 135/65
2005/0077345 A1 4/2005 March
2006/0149338 A1 * 7/2006 Flaherty ..... A61H 1/0255 607/49
2006/0174685 A1 * 8/2006 Skvortsov ..... G01C 22/006 73/1.37
2006/0292533 A1 * 12/2006 Selod ..... A63B 71/0686 434/247
2007/0085993 A1 * 4/2007 Brown ..... G01C 3/00 356/3
2012/0085377 A1 * 4/2012 Trout ..... A61H 3/00 135/66
2014/0190536 A1 * 7/2014 Friedman ..... G08C 17/02 135/66

OTHER PUBLICATIONS

Spec. Sheet: Precision Microdrives 310-101, 10mm shaftless vibration motor, 3.4mm button type (copyright 2008).
Brochure: Sharp GP2Y0A02YKOF, sheet No. E4-A00101EN.

* cited by examiner

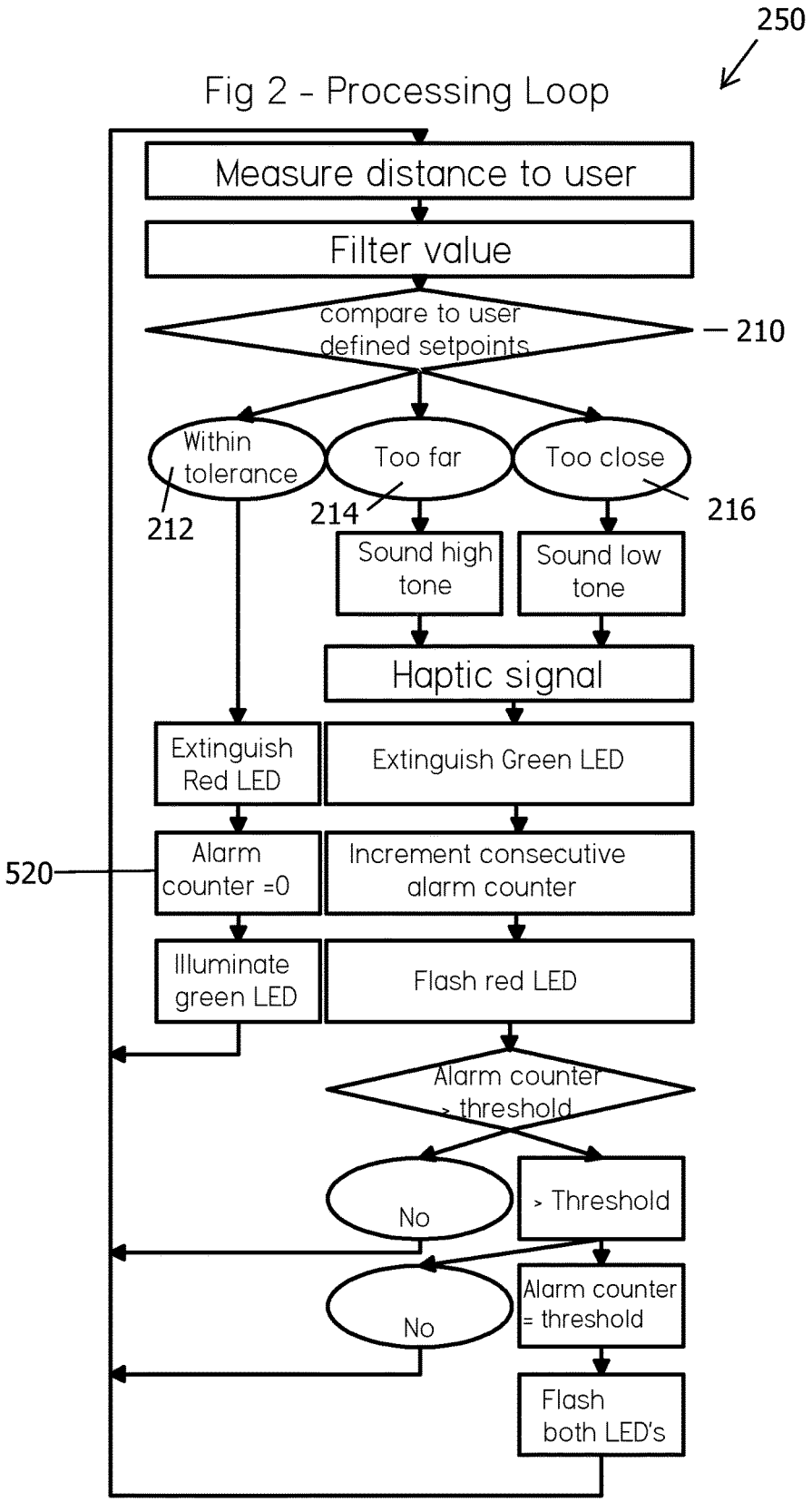
250
Fig 2 - Processing Loop
Measure distance to user
Filter value
compare to user defined setpoints
210
Within tolerance
Too far
Too close
212
214
216
Sound high tone
Sound low tone
Haptic signal
Extinguish Red LED
Extinguish Green LED
520
Alarm counter =0
Increment consecutive alarm counter
Illuminate green LED
Flash red LED
Alarm counter > threshold
No
> Threshold
No
Alarm counter = threshold
Flash both LED's

Materials

Description

610
- DescInfrared Proximity Sensor Long Range – Sharp GP2Y0A02YK0F
- Infrared Sensor Jumper Wire - 3-Pin JST
- DIP Sockets Solder Tail - 14-Pin 0.3"
- Rocker Switch - SPST (round)
- Mono Audio Amp Breakout -TPA2005D1
- AVR 14 Pin -2-DescInfrared Proximity Sensor Long Range - Sharp GP2Y0A02YK0F
- Infrared Sensor Jumper Wire 3-Pin JST
- Voltage Regulator - 5V
- Thumbwheel Potentiometer - 10k Ohm, Linear
- Vibration Motor
- LED - RGB Clear Common Cathode
- Diode Rectifier -1A 50V
- Capacitor Ceramic 0.1uF
- Electrolytic Decoupling Capacitors -10uF/25V
- Common BJT Transistors -NPN 2N3904
- Thin Speaker
- SPDT Slide Switch
- Voltage Regulator - 3.3V 0MHz 8K 12A/D - ATtiny84

FIG. 3

Walker Aide Components

| ITEM | COMPONENT | SKU | VALUE | COMMENT | COMMENT |
|---|---|---|---|---|---|
| 1 | Case front | face.stl | | | |
| 2 | Case back | butt.stl | | | |
| 3 | Case pin | dowel 1/8" x 2" | | | |
| 4 | On off rocker switch | nikkai cw-4126a 125vac | | | |
| 5 | 9 vdc battery | Energizer 9VDC | | | |
| 6 | 9 vdc battery clip | | | | |
| 7 | wire black-7 inches- 24 AWG | stk | | | |
| 8 | wire red-7 inches-24 AWG | stk | | | |
| 9 | power connector 2 pin 2510 | 2510 | | | |
| 10 | circuit board 2-1/2" x 1-1/8" single layer green board | | | ZAM3 Walker Trainer Rev 3 | |
| 11 | Slide switch 3 lead | | | | |
| 12 | Slide switch 3 lead | | | | |
| 13 | Amplifier piggy back board | Sparkfun mono audio amplifier | | | |
| 14 | resistor | b-bl-r-g | 1k ohm 5% | 1 of 2 | |
| 15 | resistor | b-bl-b-g | 100 ohm 5% | 1 of 2 | |
| 16 | resistor | b-bl-b-g | 100 ohm 5% | 2 of 2 | |
| 17 | resistor | r-r-b-g | 22 ohm 0.5% | | |
| 18 | resistor | b-bl-r-g | 1k ohm 5% | 2 of 2 | |
| 19 | transistor | 2n 3904 – d05 | | 2 | |
| 20 | yelo cap | K5n 104 | | | |
| 21 | diode | | | under amp board | |
| 22 | three pin standoff | | | 2 | |
| 23 | two pin standoff | | | 2 | |
| 24 | speaker | Sparkfun PCB mount COM-11089 RHOS | | | |
| 25 | regulator | L7805cv; 6414tv6; chn228 | 5 vdc | 1 | ST Microelectronics, Inc |
| 26 | regulator | LD33V | 3.3 vdc | 1 | ST Microelectronics, Inc |
| 27 | black cap | power smoothing | | 4 | |
| 28 | male power connector 2 pin board mount | | | | |
| 29 | nylon standoff – 3/8 long x 1/8 dia | | | 2 | |
| 30 | nylon screw | | | 4 | |
| 31 | sensor- | sharp GP2Y0A02YK0F | 5 vdc | | |
| 32 | vibrator | Sparkfun 310-101 | 3 vdc | | |
| 33 | transistor | 2n 3904-d05 | | 2 | |
| 34 | Red-green LED – 4 wire | | | | |
| 35 | 14 pin socket | | | | |
| 36 | processor | Atmel ATTINY84 | | | |
| 37 | solder | stk | | | |
| 38 | three wire connector | | | | |
| 39 | wire-red 1 inch 24 AWG | stk | | | |
| 40 | wire-black – 1 inch–24 AWG | stk | | | |
| 41 | wire- yelo – 1 inch-24 AWG | stk | | | |

FIG. 4

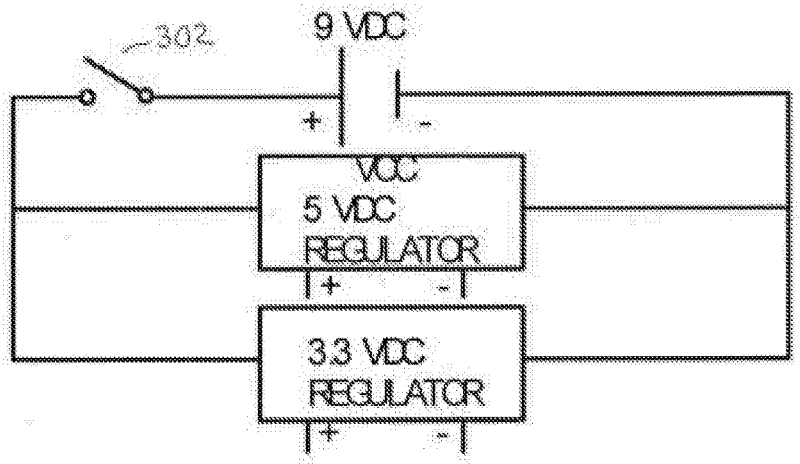
FIG. 5
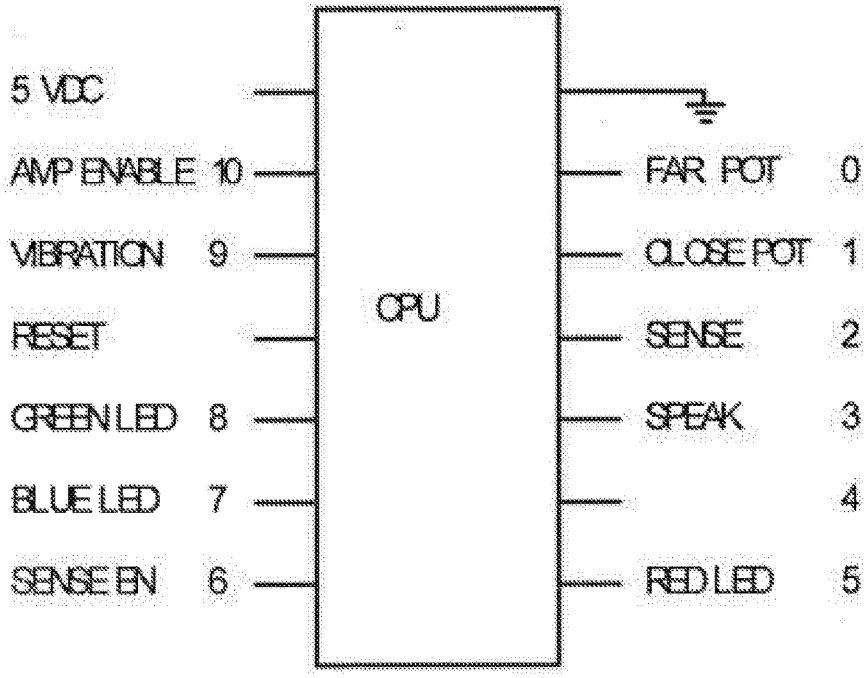
NOTE: PINS 5, 6, 7, 8, 9 ARE 3.3 VDC DIGITAL O/P
PIN 10 IS 5 VDC DIGITAL O/P
PINS 0, 1, 2 ARE ANALOG I/P
PIN 3 IS ANALOG O/P

WALKER SAFETY DEVICE

CROSS REFERENCE TO RELATED APPLICATION

This application claims the benefit of provisional application Ser. No. 62/193,172, filed Jul. 16, 2015, entitled "WALKER SAFETY DEVICE".

BACKGROUND OF THE INVENTION

This invention relates to a walker safety device and, more particularly, to a device which trains the user to stay within the confines of the walker structure so as to preclude undesirable movement relative to the walker and possible resulting injuries.

Many individuals utilize walkers to assist them with ambulatory movement. However, certain issues arise from improper walker use. One problem is the improper displacement of the user from the walker structure. If the user is outside the walker confines, i.e. too far from the walker front, the walker may slip away from the user causing user slippage and/or falls and subsequent injury. Walker issues may also arise if the user is too close to the walker front.

It is therefor desirable to have a device on the walker which alerts the user when at an undesirable distance relative to the walker, particularly at a distance beyond the confines of walker structure.

Although the use of a proximity sensor has been suggested, such suggested use was in connection with the user walking away from the walker so as to remind the user that he/she has forgotten the walker. The sensor was not used in connection with a training program so as to provide feedback to the user of proper walker use during ambulatory movement.

SUMMARY OF THE INVENTION

In response thereto I have invented a safety device which warns the user when displaced too far or too close relative to the walker structure. The device includes a housing having a proximity sensor, processor with accompanying processing software, input devices and alarms therein. The desired distances, relative to the walker, may be preset and subsequently monitored. Various visual, audial and tactile warnings alert the user as to when the set distances are not maintained. These feedbacks urge the user to maintain a desired position relative to the walker. The frequency of such undesirable user displacements, relative to the walker, can also be monitored so as to regulate the degree of feedback given to the walker user. Thus, the device is an effective tool which properly trains the user as to proper walker use.

It is therefore a general object of this invention to provide a safety device for use with a walker which provides various forms of feedback so as to advise the user of the maintenance of desired distances relative to the walker.

Another object of this invention is to provide a device, as aforesaid, which enables the user to set desired distance parameters relative to the walker.

A further object of this invention is to provide a device, as aforesaid, which trains the user to walk within the confines of the walker structure.

A still further object of this invention is to provide a device, as aforesaid, which regulates the type and degree of feedback given to the user when within or without a selected distance relative to the walker.

Other objects and advantages of this invention will become apparent from the following description taken in connection with the accompanying drawings, wherein is set forth by way of illustration and example, embodiments of this invention.

BRIEF DESCRIPTION OF THE DRAWINGS

FIG. 2 is a flow diagram showing the processing provided by the CPU software;

FIG. 3 is a list of materials utilized in the safety device;

FIG. 4 is a more detailed list of materials utilized in the safety device;

FIG. 5 illustrates an electrical diagram detail;

DESCRIPTION OF THE PREFERRED EMBODIMENT

Figure 1:
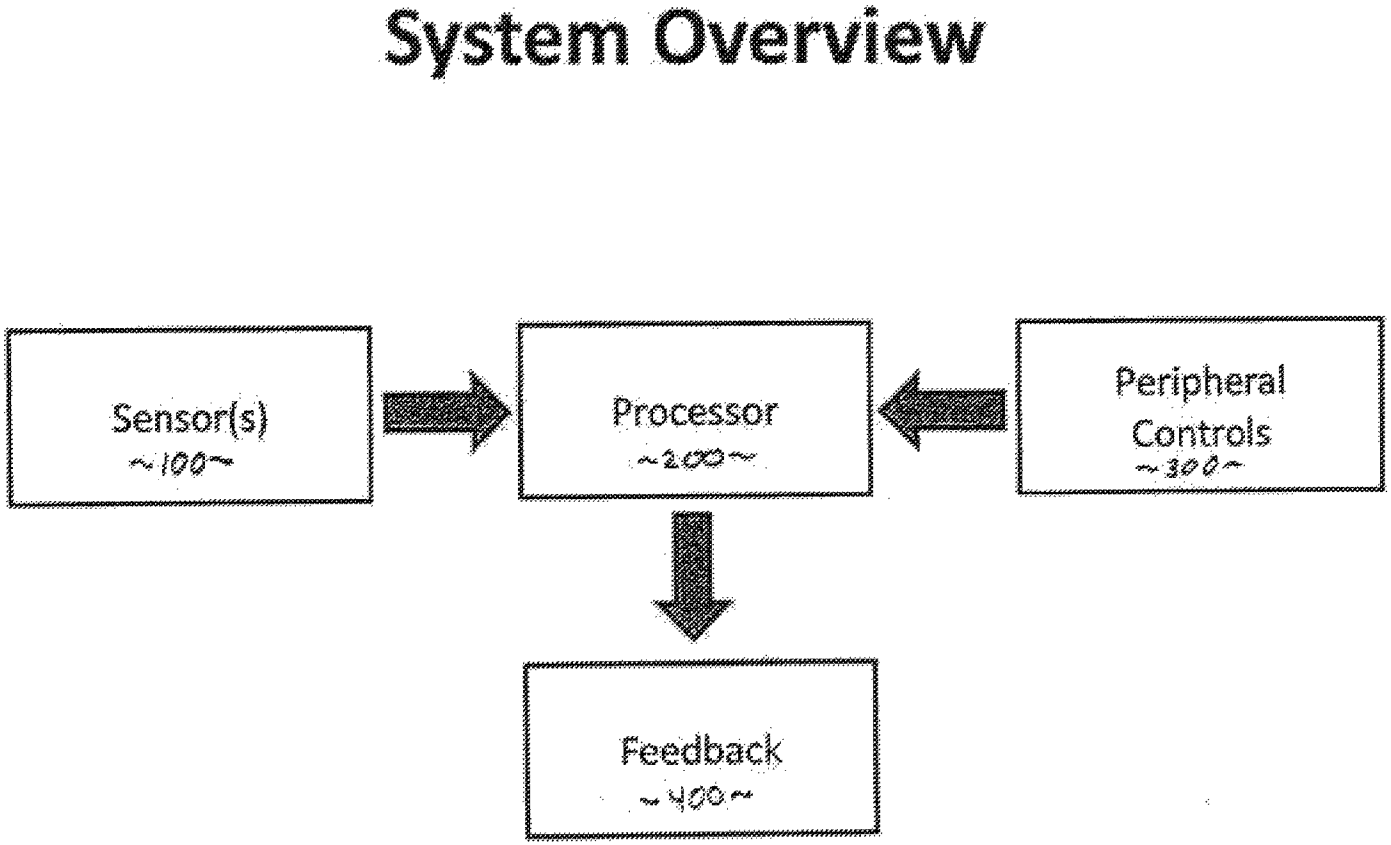
FIG. 1 is a block diagram showing the system overview.

Turning more particularly to the drawings, FIG. 1 generally illustrates the basic system configuration as including a sensor 100 with processor 200 (FIG. 5) including the logic software 250 as shown in FIG. 2. Various peripheral controls 300 enable the user to regulate the device, including the on/off switch 302, the vibrator option 304 (FIG. 6), the "potentiometer" settings of the too close 306 and too far 308 distances (FIG. 6), and the volume control 310 of the alarms 400 (FIG. 7) as controlled by switch 314. Feedback 400 to the user is provided by a red/green glowing LED 420 through lens 504, sound alarms 422 and the tactile vibratory alarm 424, which can be selectably activated by the user by the above switches. FIGS. 3 and 4 list the various elements utilized in the system, it being understood that such elements are available on the marketplace including equivalents thereof.

Figure 8:
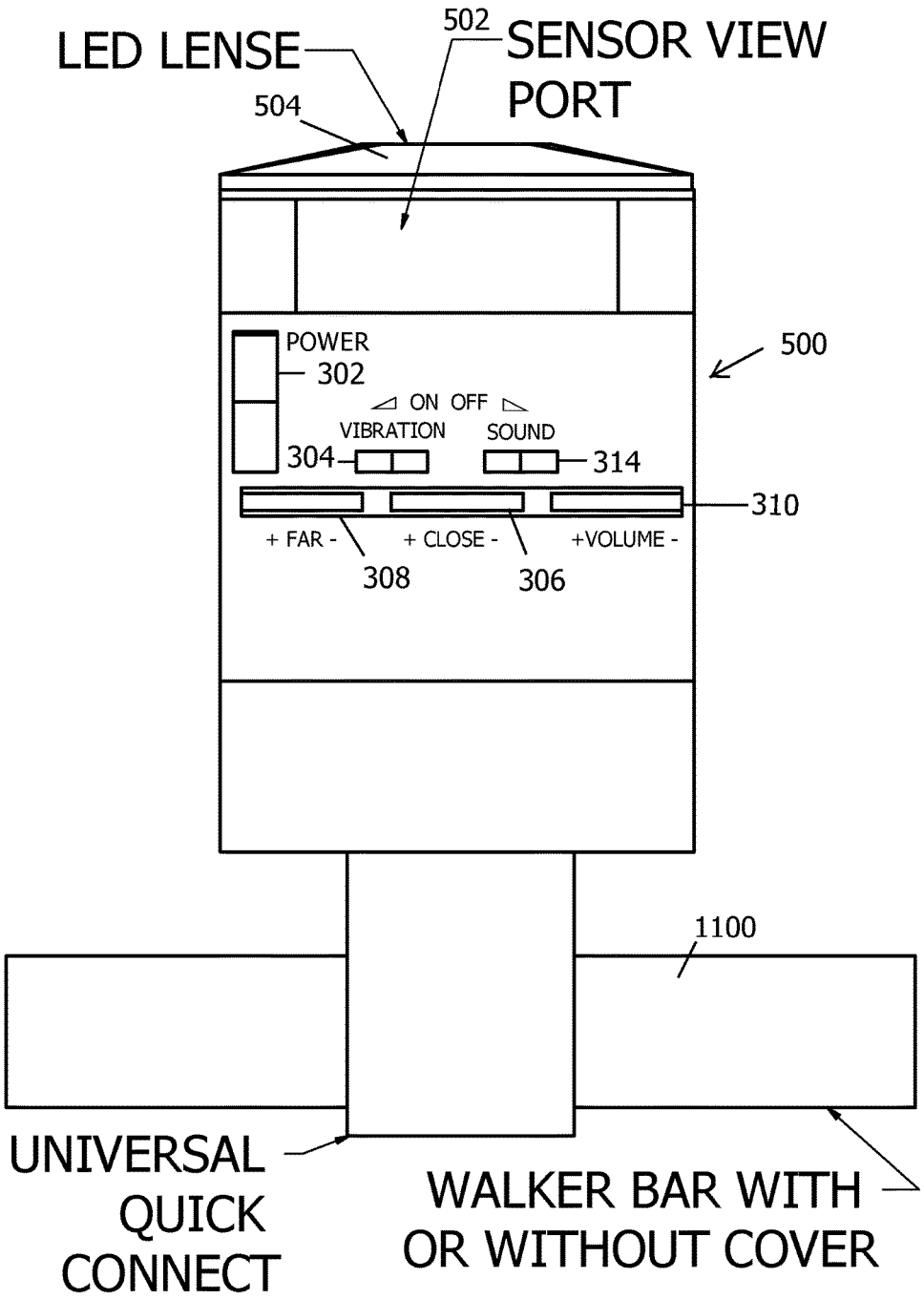
FIG. 8 illustrates one form of the housing of the device on the front cross bar of a walker.

Housing 500, which contains the FIG. 3 items, is placed on the front bar 1100 of the walker as shown in FIG. 8. Located within housing 500 and directed through port 502 is a distance measuring sensor 100 which provides an analog output. One type of sensor may be the Sharp GP2Y0A020F distance measuring unit. This sensor combines a position sensitive detector, an infrared emitting diode and a signal processing circuit. The sensor produces a voltage output corresponding to the detected distance. Thus it can be used as a proximity sensor. Its features include:

1. Distance measuring range: 20 to 150 cm
2. Analog output
3. Size: 29.5×13×21.66 mm
4. Consumption current: Typ. 33 mA
5. Supply voltage: 4.5 to 5.5 V Other characteristics as shown below:

Absolute Maximum Ratings

| Parameter | Symbol | Rating | Unit |
|---|---|---|---|
| Supply voltage | $V_{DC}$ | −0.3 to +7 | V |
| Output terminal voltage | V | −0.3 to $V_{CC}$ + 0.3 | V |
| Operating temperature | $T_{opt}$ | −10 to +60 | ° C. |
| Storage temperature | $T_{stg}$ | −40 to +70 | ° C. |

| Electro-Optical Characteristics | | | | | | |
|---|---|---|---|---|---|---|
| Parameter | Symbol | Conditions | MIN. | TYP. | MAX. | Unit |
| Average supply current | $I_{cc}$ | | — | 33 | 50 | mA |
| Measuring distance range | ΔL | | 20 | — | 150 | cm |
| Output voltage | $V_a$ | L-150 cm | 0.25 | 0.4 | 0.55 | V |
| Output voltage differential* | $\Delta V_a$ | | 1.8 | 2.05 | 2.3 | V |

*Output voltage difference between L-20 cm and L-150 cm (Note 1)

| Recommended Operating Conditions | | | | |
|---|---|---|---|---|
| Parameter | Symbol | Conditions | Rating | Unit |
| Supply voltage | $V_{cc}$ | | 4.5 to 5.5 | V |

Figure 6:
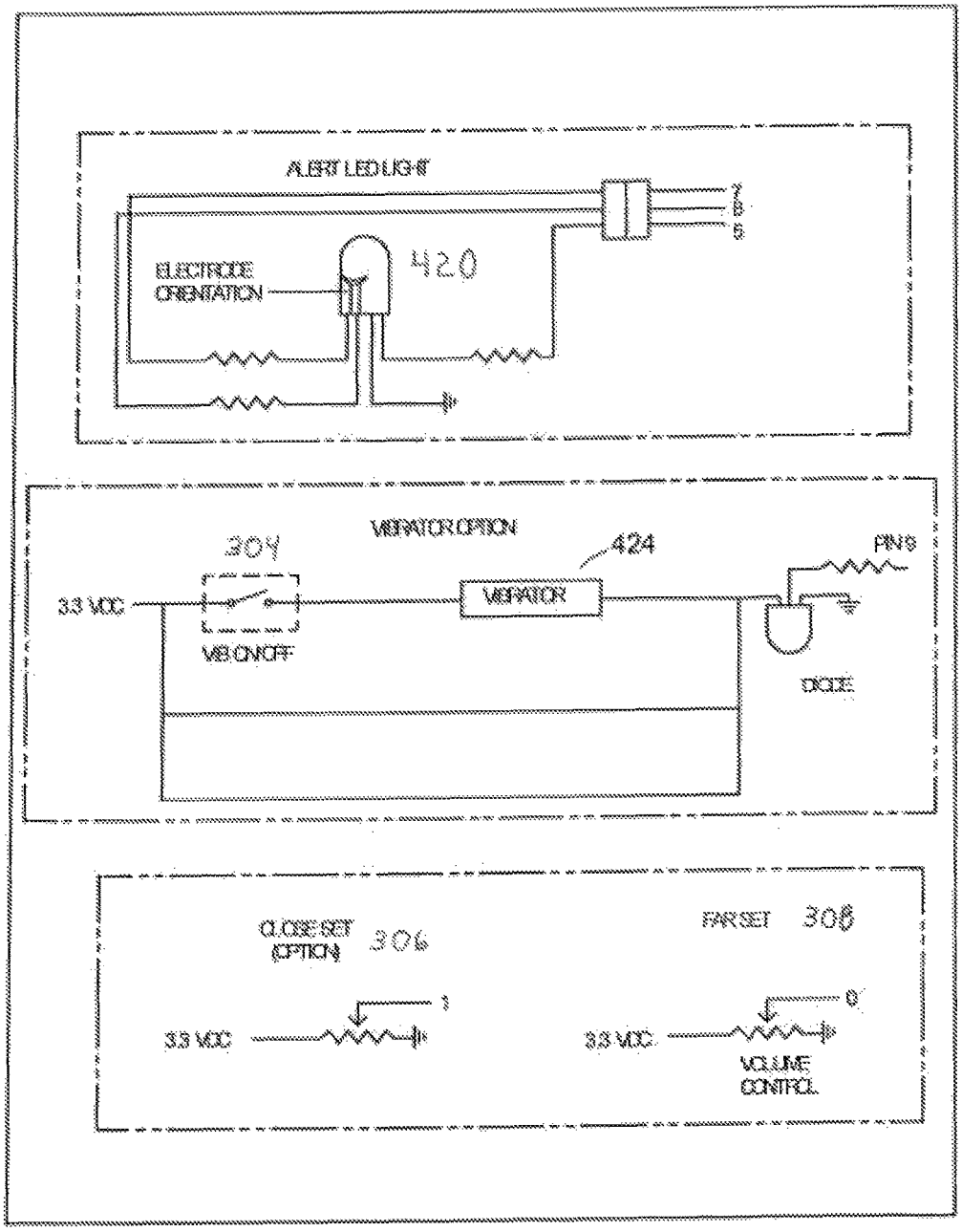
FIG. 6 further illustrates electrical diagram details of the alert red light, vibrator and distance set functions.

As shown above, the housing contains the proximity sensor 100, which has a measuring distance capable of 20 to 150 cms. This distance range will include the desired displacements of the user from the front cross bar 1100 of the walker, i.e., a too "close" or a too "far" distance. As shown in the electrical diagram these too "close" or too "far" distances can be preset by dials 306, 308 which control potentiometers (FIG. 6). These resulting voltage outputs, corresponding to the too close or too far distances of the user from the sensor, can then be processed by the FIG. 2 logic. (See FIG. 5: Close Pot/Pin 1, Far Pot/Pin 0).

Figure 7:
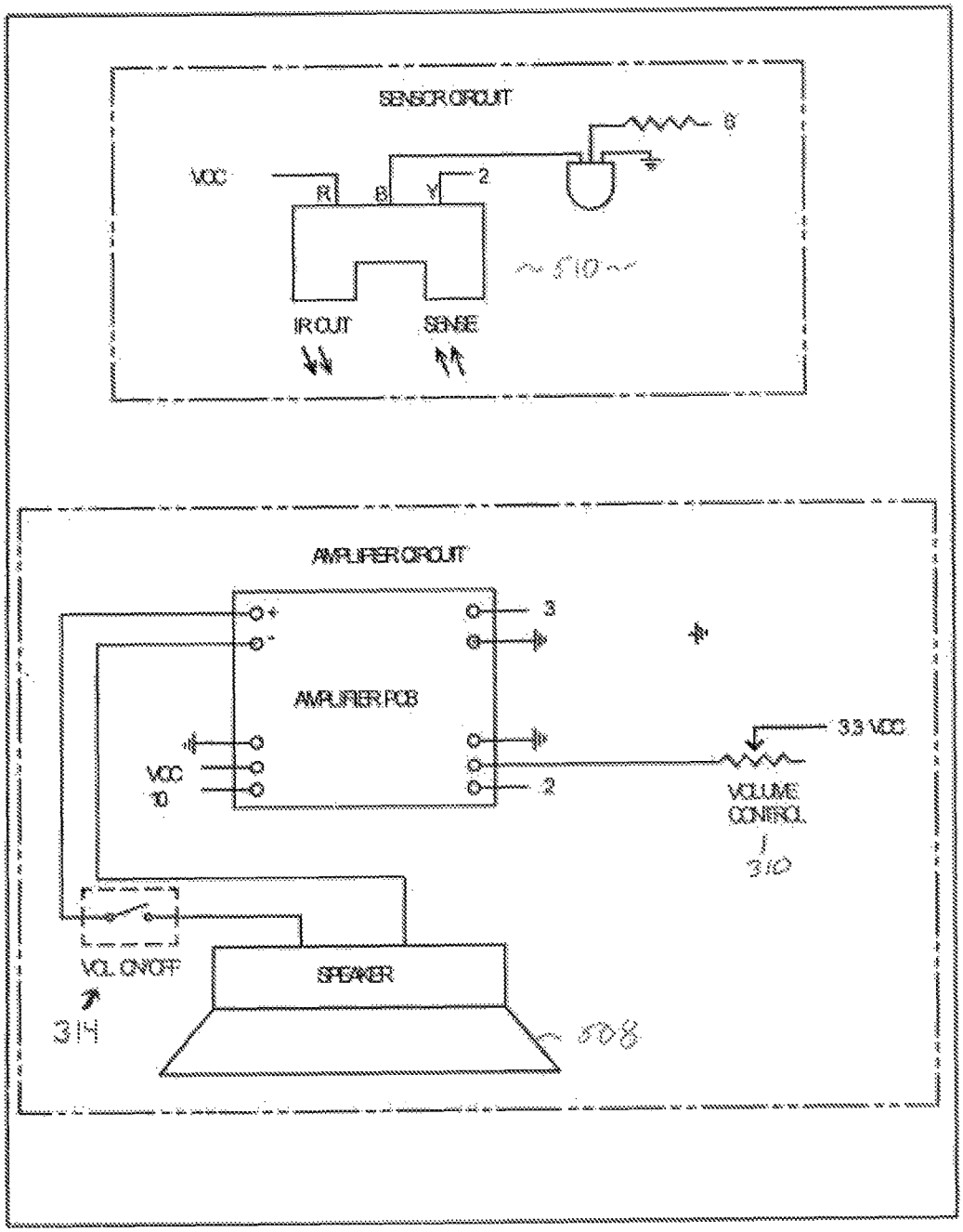
FIG. 7 illustrates the electrical detail of the sensor and amplifier circuits of the safety device.

As shown in FIG. 2, the CPU signal processing receives the incoming voltage and first determines whether the data provided by the sensor 100, is within the user-defined too far or too close set points (210) set by controls 308, 306. If so, the glowing red LED 420, if lit, is extinguished (FIG. 6), the alarm counter 520 is set to zero and the LED 420 will glow green through lens 504. If beyond a desired distance (214), the LED 420 glows red and a high audio alarm 422 is energized as controlled by a signal sent by the program logic (FIG. 7).

Optionally, the software also detects whether the signal indicates the user is too close (216) to the walker. As such, the program logic will send a signal to the amplifier circuit (FIG. 7) such that a lower audio alarm is energized via the speaker 508 as this displacement is not as critical as a too "far" displacement. It is understood that the processing logic may be modified so as to address only sensor signals which indicate that the user is too far away from the sensor 100, i.e., outside the confines of the walker. In either case the green glow of LED 420 is extinguished.

A counter 520 may also be utilized in the processing logic to count the extent of the user's undesirable displacements relative to the walker whether too far, too close or both. Once the alarm counter 520 reaches a preselected threshold of undesirable displacements, LED 420 is energized so as to glow both colors. Accordingly, the frequency of warnings of undesirable displacements provided to the user may be regulated during ambulatory movement rather than warnings being given each time the user moves to an undesirable displacement.

As such the CPU processing software provides the user with various visual, audio and tactile alarms indicative of the user drifting too close or away or both from the walker. Thus, the user can take corrective action. Once the number of such undesirable displacements is reached without correction, the user is provided with a plurality of alarms. These multiple alarms advise the user as well as other personnel of a user's problem with the walker.

Also, haptic/tactile feedback may also be provided to the user if too "close" or "far" displacements are detected (see FIG. 6: Vibration Option). A vibration motor 304, e.g., as the Spark Fun/Precision 310-101 shaftless vibration motor can be used. Once energized the vibration will move along the walker structure so as to be sensed by the user. Such feedback can be valuable to users having audial and/or visual difficulties.

It is also understood that the above disclosure enables one to modify the processing logic so as to provide various levels of feedback to the user, e.g., visual only, audio only, tactile only or various combinations thereof with or without the counter function.

It is understood that the above logic software is effective in training the new user. Thus, the safety device can be used in both training and continuing use environments.

It is to be understood that while certain forms of this invention have been illustrated and described, it is not limited thereto, except in so far as such limitations are included in the following claims and allowable equivalents thereof.

Having thus described the invention, what is claimed as new and desired to be secured by this Patent is as follows:

1. A safety device for a walker comprising:

a housing configured for attachment to a walker along a front side thereof, said housing presenting at least a first electronic warning display;

an electronic sensor within said housing for providing data corresponding to a distance of a user from the front side of the walker, said data including a first set of data indicative of a user of the walker being at a first distance from the front side of the walker, said data also including a second set of data indicative of a user being at a second distance from the front side of the walker;

an electronic module coupled with the sensor for processing said data provided by said sensor, said electronic module energizing at least said first electronic warning display upon said processing of said first data set if said first distance is greater than a first preset distance, and said electronic module energizing at least said first electronic warning display upon said processing of said second data set if said second distance is less than a second preset distance, wherein said second preset distance is less than said first preset distance.

2. The device as claimed in claim 1 wherein said at least first electronic warning display comprises first and second audial tones, said first audial tone energized upon said processing of said first data set if said first distance is greater than said first preset distance and said second audial tone energized upon said processing of said second data set if said second distance is less than a second preset distance.

3. The device as claimed in claim 2 wherein said second audial tone comprises a volume greater than said first audial tone.

4. The device as claimed in claim 1 wherein said at least first electronic warning display comprises a second warning display presenting a stimulus not presented by said first electronic warning display.

5. The device as claimed in claim 4 wherein said stimulus provided by said second warning display comprises a visual stimulus, said visual stimulus energized by said module upon said processing of said first or second data sets or both.

6. The device as claimed in claim 4 further comprising a tactile warning display presenting a stimulus differing from said stimulus provided by said at least first and second warning displays, said tactile warning display energized upon said processing of said first or second data sets or both.

7. The device as claimed in claim 1 further comprising:

a counter in said electronic module having a starting zero position, said counter count at said zero position precluding said electronic module from energizing said at least said first electronic warning display;

a threshold count having a preselected value, said counter count incremented upon each processing of said first data set if said first distance is greater than said first preset distance, said electronic module energizing said at least first warning display upon said counter count reaching said threshold count.

8. The device as claimed in claim 1 further comprising:

a counter in said electronic module having a starting zero position, said counter at said zero position precluding said electronic module from energizing at least said first electronic warning display;

a threshold count having a preselected value, said counter count incremented upon each processing of said first or second data sets or both if said first distance is greater than said first preset distance or if said second distance is less than said second preset distance, said electronic module energizing at least said first electronic warning display upon said counter count reaching said threshold count.

9. The device as claimed in claim 8 wherein said counter is set at said zero position upon said processing of data being neither a first data set nor a second data set or both.

10. A safety device for a walker comprising:

a housing configured for attachment to a walker along a front side thereof, said housing presenting first and second warning displays;

an electronic sensor within said housing for providing data corresponding to a distance of a user of the walker from the housing, said provided data including data corresponding to a first distance of the user from said housing, said provided data also including data corresponding to a second distance of the user from said housing; and a processor coupled with the sensor for analyzing said provided data, said processor energizing said first warning display upon analyzing said data corresponding to said first distance if said first distance is greater than a first preset distance, said processor energizing said second warning display upon analyzing said data corresponding to said second distance if said second distance is less than a second preset distance, wherein said second preset distance is less than said first preset distance.

11. The device as claimed in claim 10 wherein said first warning display comprises a first audial tone.

12. The device as claimed in claim 11 wherein said second warning display comprises a second audial tone different in volume from said first audial tone, whereby said first and second audial tones are indicative of the user's proximity to said housing.

13. The device as claimed in claim 10 further comprising a second warning display presenting a warning different than said first warning display.

14. The device as claimed in claim 13 wherein said second warning display comprises a tactile stimulus.

15. The device as claimed in claim 14 wherein said housing includes a vibrator, said vibrator providing said tactile stimulus to the user grasping said walker.

16. The device as claimed in claim 11 further comprising a display other than said first and second warning displays energized by said processor upon analyzing data provided by said sensor if said first distance is not greater than said first preset distance and said second distance is not less than said second preset distance.

17. The device as claimed in claim 10 comprising:

a counter coupled to said processor having a starting zero position, said counter at said zero position precluding said processor from energizing said first warning display;

a threshold count having a preselected value, said counter incremented upon each analyzing of said data corresponding to said first distance if said first distance is greater than said first preset distance, said processor energizing said first warning display upon said counter count reaching said threshold count.

18. A safety walker device comprising:

a housing configured for attachment to a walker along a front side thereof;

means for providing a visual stimuli to a user of the walker:

means for providing an audial stimuli to a user of the walker:

means for providing tactile stimuli to a user of the walker;

a sensor within said housing for providing data indicative of a distance of a user of the walker from the housing; and a processor coupled with the sensor for interpreting the data received from the sensor, said processor comparing said data received from the sensor to a first preset data point corresponding to a first distance of the user from said housing and a second preset data point corresponding to a second distance of the user from said housing, wherein said first distance is greater than said second distance, said processor including logic for energizing the visual or tactile or audial stimuli means or combination thereof upon comparing said data received from the sensor to the first and second preset data points if said data indicates a user of the walker is a distance from the housing that is greater than said first distance or less than said second distance.

* * * * *